US009598189B2

(12) United States Patent
Taylor

(10) Patent No.: US 9,598,189 B2
(45) Date of Patent: Mar. 21, 2017

(54) PACKAGING MACHINE FORMER

(75) Inventor: Alfred Alexander Taylor, Lugarno (AU)

(73) Assignee: TNA Australia Pty Limited, Lidcombe (AU)

( * ) Notice: Subject to any disclaimer, the term of this patent is extended or adjusted under 35 U.S.C. 154(b) by 838 days.

(21) Appl. No.: 13/421,596

(22) Filed: Mar. 15, 2012

(65) Prior Publication Data

US 2012/0233970 A1 Sep. 20, 2012

(30) Foreign Application Priority Data

Mar. 17, 2011 (AU) ..... 2011900972

(51) Int. Cl.
*B65B 9/22* (2006.01)
*B65B 31/04* (2006.01)

(52) U.S. Cl.
CPC ..... *B65B 9/22* (2013.01); *B65B 31/045* (2013.01)

(58) Field of Classification Search
CPC .... B65B 9/06; B65B 9/10; B65B 9/22; B65B 51/26; B65B 31/02; B65B 31/045; B65B 59/04; B65B 9/2014; B65B 9/2021; B65B 9/2028; B65B 9/2035
USPC ..... 53/545, 551, 558, 563, 201, 511; 493/186, 302, 269
See application file for complete search history.

(56) References Cited

U.S. PATENT DOCUMENTS 1,986,422 A * 1/1935 Zwoyer ..... B65B 9/2014 264/DIG. 37
2,899,875 A * 8/1959 Leasure ..... B65B 9/22 493/302
2,969,627 A * 1/1961 Leasure ..... B65B 9/213 493/302
2,982,334 A * 5/1961 Cooper et al. ..... B65B 51/26 100/305
3,042,103 A * 7/1962 McDevitt ..... B29C 53/52 156/203
3,067,555 A * 12/1962 Newell et al. ..... B65B 9/22 53/551
3,070,931 A * 1/1963 Zwight ..... B65B 9/213 177/185
3,086,335 A * 4/1963 Frank ..... B65B 9/22 53/551

(Continued)

FOREIGN PATENT DOCUMENTS

DE 1114429 B * 9/1961 ..... B65B 9/2028
DE 2005640 A1 * 8/1971 ..... B65B 9/22

(Continued)

OTHER PUBLICATIONS

British Search Report mailed on Jul. 6, 2012 for GB Patent Application No. GB1204599.3, 3 pages.

(Continued)

*Primary Examiner* — Stephen F Gerrity
(74) *Attorney, Agent, or Firm* — Kilpatrick Townsend & Stockton LLP

(57) ABSTRACT

A former assembly (10) for a packaging machine. The assembly (10) includes a frame (11) including a frame member (12) of "U-shaped" configuration. The frame (11) supports a former (17) having a former surface (18) over which stripped bag materials passes to be formed into a tubular configuration.

19 Claims, 2 Drawing Sheets

(56) References Cited

U.S. PATENT DOCUMENTS 3,267,822 A * 8/1966 Harrison ..... B65B 9/22 493/302
3,415,171 A * 12/1968 Wilson ..... B65B 9/22 493/302
3,486,424 A * 12/1969 Tanner ..... B65B 9/22 493/302
3,494,265 A * 2/1970 Middour ..... B65B 9/22 493/302
3,636,826 A * 1/1972 Bowen et al. ..... B65B 9/22 493/417
3,779,836 A * 12/1973 Henry et al. ..... B65B 9/213 156/203
3,792,724 A * 2/1974 Hunter ..... B65B 9/213 141/115
3,861,121 A * 1/1975 Monsees ..... B65B 9/213 198/370.08
3,948,150 A * 4/1976 Hobart ..... B65B 9/22 156/466
4,043,098 A * 8/1977 Putnam, Jr. et al. ..... B65B 9/22 156/466
4,084,999 A * 4/1978 Rucker ..... B65B 51/26 138/151
4,109,792 A * 8/1978 Greenawalt et al. . B65B 9/2042 156/251
4,118,913 A * 10/1978 Putnam, Jr. et al. . B65B 9/2028 53/551
4,262,470 A * 4/1981 Reuter et al. ..... B65B 9/213 53/202
4,322,929 A * 4/1982 Neumann ..... 53/451
4,532,754 A * 8/1985 Hokanson ..... B65B 9/213 383/200
4,576,588 A * 3/1986 Umeda et al. ..... B65B 9/22 493/302
4,753,336 A 6/1988 Taylor
4,910,943 A * 3/1990 Taylor et al. ..... B65B 9/2028 226/95
4,950,345 A * 8/1990 Kreager, Jr. et al. ... B29C 65/02 156/203
4,991,379 A * 2/1991 Boeckmann ..... B65B 9/22 53/451
4,993,212 A * 2/1991 Veoukas ..... B65B 9/22 493/302
5,622,032 A 4/1997 Ryan
5,707,329 A * 1/1998 Pool et al. ..... 493/302
5,845,465 A * 12/1998 Bennett ..... B65B 9/22 53/374.3
5,983,610 A * 11/1999 Fukuda ..... B65B 9/20 53/551
6,131,367 A * 10/2000 Fukuda et al. ..... B65B 9/22 493/302
6,314,706 B1 * 11/2001 Araki et al. ..... B65B 9/2028 53/451
6,428,457 B1 * 8/2002 Fukuda et al. ..... B65B 9/22 493/302
6,513,308 B1 * 2/2003 Meeuwesen et al. .. B65B 9/213 493/302
6,589,147 B2 * 7/2003 Dominguez et al. ..... 493/269
6,619,018 B1 * 9/2003 Sasaki ..... 53/511
6,811,530 B2 * 11/2004 Watanabe ..... B29C 53/387 493/269
6,951,090 B2 * 10/2005 Kondo et al. ..... B65B 9/2028 493/302
7,124,559 B2 10/2006 Taylor
7,152,387 B2 * 12/2006 Taylor ..... 53/511
7,159,376 B2 1/2007 Taylor
7,313,901 B2 * 1/2008 Kakita et al. ..... 53/434
7,415,809 B2 * 8/2008 Taylor ..... 53/167
7,523,597 B2 * 4/2009 Dominguez et al. ..... 53/451
2001/0005974 A1 * 7/2001 Kondo et al. ..... B65B 9/2021 53/508
2005/0044822 A1 * 3/2005 Braun et al. ..... B65B 9/22 53/551
2005/0208185 A1 * 9/2005 Sugimura et al. .... B65B 9/2028 426/115
2008/0229712 A1 9/2008 Dominguez et al.
2009/0288376 A1 * 11/2009 Ichikawa et al. ..... B65B 9/22 53/551
2010/0037568 A1 * 2/2010 Hashimoto et al. ..... B65B 9/22 53/551

FOREIGN PATENT DOCUMENTS

DE 19539830 A1 * 4/1997 ..... B65B 9/22
DE 19539872 A1 * 4/1997 ..... B65B 9/22
DE 102007050697 B3 * 9/2008 ..... B65B 9/22
EP 0 479 594 A2 4/1992
EP 0 718 196 A1 6/1996
EP 1 454 735 A2 9/2004
EP 1 495 967 A1 1/2005
ES 2311782 T3 2/2009
GB 965 876 8/1964
GB 1 203 684 A 9/1970
GB 1 456 686 A 11/1976
GB 2 409 847 A 7/2005
JP 5926408 2/1984
JP 5-58602 U 8/1988
NL 7100668 A 7/1972
WO WO 9532897 A1 * 12/1995 ..... B65B 9/22
WO WO 2010018239 A1 * 2/2010 ..... B65B 9/2028

OTHER PUBLICATIONS

Search Report mailed Mar. 6, 2013 in Spanish Patent Application No. ES201230404, 6 pages.
British Examination Report dated May 19, 2016 from corresponding British Application (4 pages), Application No. GB 1204599.3.
British Examiner's Report dated Oct. 11, 2016 from corresponding British Application, GB1204599.3 (3 pages).

* cited by examiner

PACKAGING MACHINE FORMER

CROSS-REFERENCE TO RELATED APPLICATIONS

This application claims priority to Australian Provisional Application No. 2011900972, filed Mar. 17, 2011, the disclosure of which is incorporated by reference herein.

TECHNICAL FIELD

The present invention relates to formers for packaging machines.

BACKGROUND OF THE INVENTION

Formers are employed to receive bag material in strip form, and reconfigure the strip into tubular bag material for delivery to a packaging machine. Product is delivered to the interior of the tube with the packaging machine then forming transverse seals and transversely cutting the bag material to form bags of product. As a particular example, the product may be a snack food such as a potato crisps.

Traditionally, such as bags of snack foods have been packaged in boxes for delivery to points of sale. More recently the size of the bags has been increasing. This has necessitated the use of larger formers since wider strip bag material is being used so that the tubular bag material is larger in diameter. Large bags are also employed to receive a number of smaller bags.

Formers need to be removed from their mounting adjacent the packaging machine for various reasons, including servicing of the former as well as changing the former so that different sized bags can be manufactured.

Formers are relatively heavy and are mounted in awkward positions. Accordingly the removal and replacement of formers presents a problem.

A former assembly includes a mounting plate to which there is attached a metal sheet that provides the former surface over which the strip bag material passes to be reconfigured into a tubular configuration. The former surface converges upwardly to an upper opening through which there projects a product tube, via which product is delivered to the interior of the bag material.

A disadvantage of the above discussed former assemblies is that the former assemblies are particularly heavy and therefore difficult to manage.

OBJECT OF THE INVENTION

It is the object of the present invention to overcome or substantially ameliorate the above disadvantage.

SUMMARY OF THE INVENTION

There is disclosed herein a former assembly for a packaging machine, the assembly including:

a frame to be fixed relative to the packaging machine so that the assembly can deliver tubular bag material to the packaging machine;

a former mounted on the frame, the former being provided to receive strip bag material and reconfigure the strip material into the tubular bag material, the former including a former surface over which the strip material passes to be reconfigured, the former surface converging upwardly to a former opening;

a product delivery (tube) chute extending downwardly to adjacent the opening and via which product is delivered to the interior of the tubular bag material; and wherein the frame includes an elongated frame member having a central elongated base having opposite end portions, and an arm extending from each end portion with the former being supported by the arm, with the member being tubular to provide for delivery of gas to the interior of the tubular bag material.

Preferably, said elongated frame member (is tubular and) is of a "U-shaped" configuration so as to provide said base and arms that extend horizontally from the base.

Preferably, each arm extends from the base so as to terminate at an end extremity spaced from the base, with the former at least partly supported adjacent the end extremities.

Preferably, a support member is fixed to the former and extends between arms to support the former.

Preferably, said former has a lower periphery, with at least portion of the periphery being bent, which periphery portion extends between the end extremities.

Preferably, said frame includes an upwardly extending chute support having a lower portion attached to the base and an upper portion attached to said delivery chute.

Preferably, said delivery chute support is formed of tubular material.

Preferably, said surface has a plurality of ridges radiating outwardly and downwardly from said opening.

Preferably, said former has an annular edge of arcuate transverse cross-section surrounding said opening and from which said surface diverges downwardly.

Preferably, said edge is a bead.

Preferably, each arm extends from the base so as to terminate at an end extremity spaced from the base, with the former at least partly supported adjacent the end extremities.

Preferably, a support member is fixed to the former and arms to support the former.

Preferably, said former has a lower periphery, with at least portion of the periphery being bent, which periphery portion extends between the end extremities.

Preferably, said frame includes an upwardly extending chute support having a lower portion attached to the base and an upper portion attached to said delivery chute.

Preferably, said delivery chute support is formed of tubular material.

Preferably, said surface has a plurality of ridges radiating outwardly and downwardly from said opening.

Preferably, said former has an annular edge of arcuate transverse cross-section surrounding said opening and from which said surface diverges downwardly.

Preferably, said edge is a bead.

Preferably, the assembly further includes at least one of the arms having a gas coupling to provide delivery of the gas to the frame member.

BRIEF DESCRIPTION OF THE DRAWING

A preferred form of the present invention will now be described by way of example with reference to the accompanying drawings wherein:

FIG. 3 is a schematic isometric enlarged view of portion of the assembly of FIG. 2.

DETAILED DESCRIPTION OF THE PREFERRED EMBODIMENT

In the attached drawings there is schematically depicted a former assembly 10 for a packaging machine, such as that described in U.S. Pat. Nos. 5,622,032, 7,159,376 and 4,753,336.

Figure 1:
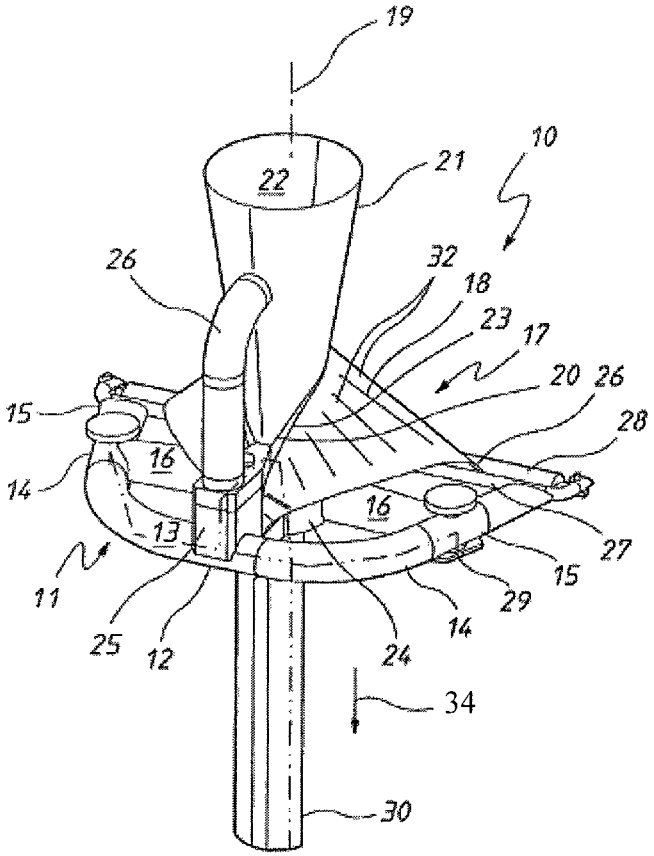
FIG. 1 is a schematic isometric view of a former assembly for a packaging machine.
Figure 2:
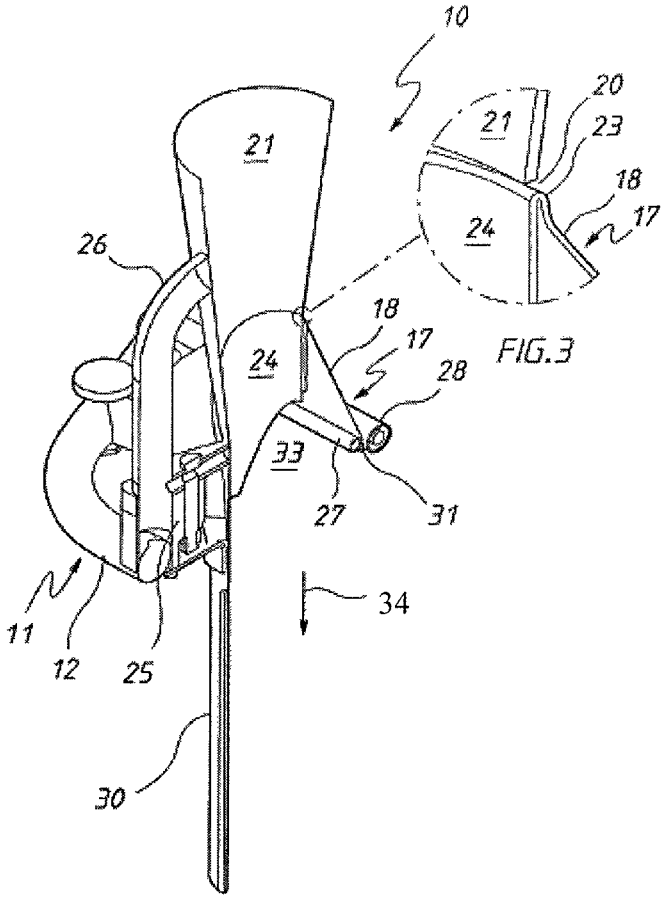
FIG. 2 is a schematic vertical sectioned isometric view of the assembly of FIG. 1.

The former assembly 10 includes a frame 11 including a first frame member 12 that is of a "U-shaped" configuration so as to have a base 13 from which there extends diverging arms 14. As best seen in FIG. 1, the frame member 12 is horizontally oriented so that the arms 14 extend horizontally from the base 13. The frame member 12 is tubular in construction so as to have a longitudinally extending passage to which a gas may be delivered.

The frame 11 further includes transverse support members 16 fixed to end portions 15 of the arms 14, the member 16 extending inwardly.

Supported by the frame 11 is a former 17 having a former surface 18 over which strip bag material passes to be formed into a tubular configuration. The surface 18 generally surrounds an upright axis 19 and converges upwardly towards the axis 19 to form an annular former opening 20 surrounding the axis 19 passes. Extending toward the opening 20 is a product delivery tubular chute 21 having an interior 22 to which product is delivered for delivery to the interior of the tubular bag material from which bags of product are formed.

The opening 20 is located at the lower end the chute 21 so that bag material engaged with and moving upwardly over the surface 18 is allowed to be redirected downwardly through the opening 20 to then extend in the direction 34 to the packaging machine below.

The surface 18 extends upwardly and terminates at the opening 20 with an annular bead 23 adjacent the opening 20. The bead 23 is in the form of an arcuate edge. A tubular portion 24 of the former 17 extends downwardly from the bead 23. The tubular bag material slides downwardly inside the tubular portion 24 of the chute 21 for delivery to the packaging machine below.

The former 17 is supported by the members 16 by being fixed to the tubular portion 24 of the former 17.

The frame 11 further includes a central mounting 25 fixed to the base 13 so as to extend upwardly therefrom. Fixed to the mounting 25 is an upwardly extending support 26 fixed at its upper end to the product delivery chute 21 to support the chute 21. The chute 21 may also be attached to the mounting 25 so as to be further supported thereby.

The former 17 has a peripheral transverse length 31 that is folded so as to aid in increasing the rigidity of the former 17. This transverse length 31 is secured to a transverse member 27 fixed to the end portions 15. A roller 28 is located adjacent to but spaced from the transverse portion 26 to aid in the delivery of the sheet bag material to the surface 18. The former 17 is therefore supported by the arms 14.

One or both of the arms 15 is provided with a coupling 29 via which a gas can be delivered to the interior of the member 12. As the member 12 is of a tubular construction, the gas can be delivered to the mounting portion 25 from where it is delivered to a backing member 30 (extending from the tubular portion 24) for delivery of gas to the interior of the tubular bag material. If so required, the member 26 may also be tubular for the delivery of a gas to the interior of the product delivery chute 21.

The surface 18 has ridges 32 radiating outwards and downwards from the opening 20 and projecting from the surface 18.

The tubular portion 24 has a recess 33 that provides access to the film when the film is initially being fed into the tubular portion 24.

The invention claimed is:

1. A former assembly for a packaging machine, the assembly comprising:

a frame configured to be fixed relative to the packaging machine so that the assembly delivers tubular bag material to the packaging machine;

a former mounted on the frame, the former being configured to receive strip bag material and reconfigure the strip material into the tubular bag material into which product to be packed is delivered, the former comprising a former surface configured for the strip material to pass over the former surface to thereby be reconfigured, the former surface converging upwardly to a former opening; and a product delivery chute extending downwardly to adjacent the opening and configured for product to be delivered to the interior of the tubular bag material via the product delivery chute;

wherein the former includes a tubular portion extending down from the former opening, with the tubular portion receiving the tubular bag material, and the frame comprises an elongated frame member having a central elongated base having opposite end portions, and an arm extending from each end portion with the former being supported by the arms, and a support member extending inwards from each arm to the tubular portion to support the former, wherein said elongated frame member is hollow to thereby provide for the delivery of a gas to the interior of the tubular bag material through the elongated frame member.

2. The former assembly of claim 1, wherein said elongated frame member is U-shaped in plan view so as to provide said base and arms.

3. The former assembly of claim 2, wherein each arm extends from the base so as to terminate at an end extremity spaced from the base, with the former at least partly supported adjacent the end extremities.

4. The former assembly of claim 3, wherein said former has a lower periphery, with at least a portion of the periphery being bent, which periphery portion extends between the end extremities.

5. The former assembly of claim 4, wherein said frame includes an upwardly extending chute support having a lower portion attached to the base and an upper portion attached to said product delivery chute.

6. The former assembly of claim 5, wherein said chute support is formed of tubular material.

7. The former assembly of claim 2, further comprising a gas coupling disposed on at least one of the arms, wherein the gas coupling is configured to provide the gas to the frame member.

8. The former assembly of claim 1, wherein each arm extends from the base so as to terminate at an end extremity spaced from the base, with the former at least partly supported adjacent the end extremities.

9. The former assembly of claim 8, wherein said former has a lower periphery, with at least a portion of the periphery being bent, which periphery portion extends between the end extremities.

10. The former assembly of claim 1, wherein said frame includes an upwardly extending chute support having a lower portion attached to the base and an upper portion attached to said product delivery chute.

11. The former assembly of claim 10, wherein said chute support is formed of tubular material.

12. The former assembly of claim 1, wherein said surface has a plurality of ridges radiating outwardly and downwardly from said opening.

13. The former assembly of claim 1, wherein said former has an annular edge of arcuate transverse cross-section surrounding said opening and from which said surface diverges downwardly.

14. The former assembly of claim 13, wherein said edge is a bead.

15. The former assembly of claim 1, wherein said surface has a plurality of ridges projecting from said surface and radiating outwardly and downwardly from said opening.

16. The former assembly of claim 15, wherein said former has an annular edge of arcuate transverse cross-section surrounding said opening and from which said surface diverges downwardly.

17. The former assembly of claim 16, wherein said edge is a bead.

18. The former assembly of claim 1, wherein the frame member is tubular.

19. The former assembly of claim 1, further comprising a gas coupling disposed on at least one of the arms, wherein the gas coupling is configured to provide the gas to the frame member.

* * * * *